US009644440B2

(12) United States Patent
Kerstetter

(10) Patent No.: US 9,644,440 B2
(45) Date of Patent: May 9, 2017

(54) SYSTEMS AND METHODS FOR PRODUCING FORCED AXIAL VIBRATION OF A DRILLSTRING

(71) Applicant: Laguna Oil Tools, LLC, Youngsville, LA (US)

(72) Inventor: Scott Kerstetter, Lafayette, LA (US)

(73) Assignee: LAGUNA OIL TOOLS, LLC, Youngsville, LA (US)

( * ) Notice: Subject to any disclaimer, the term of this patent is extended or adjusted under 35 U.S.C. 154(b) by 135 days.

(21) Appl. No.: 14/497,569

(22) Filed: Sep. 26, 2014

(65) Prior Publication Data

US 2015/0107904 A1 Apr. 23, 2015

Related U.S. Application Data

(60) Provisional application No. 61/893,818, filed on Oct. 21, 2013.

(51) Int. Cl.

| | |
|---|---|
| ***E21B 4/10*** | (2006.01) |
| ***E21B 28/00*** | (2006.01) |
| ***E21B 4/02*** | (2006.01) |
| ***E21B 17/03*** | (2006.01) |

(52) U.S. Cl.

CPC ..... *E21B 28/00* (2013.01); *E21B 4/02* (2013.01); *E21B 4/10* (2013.01); *E21B 17/03* (2013.01)

(58) Field of Classification Search

CPC ..... E21B 6/00; E21B 6/02; E21B 6/04; E21B 4/10

See application file for complete search history.

(56) References Cited

U.S. PATENT DOCUMENTS

| | | | | |
|---|---|---|---|---|
| 2,146,454 | A | 2/1939 | Sutliff | |
| RE26,745 | E * | 12/1969 | Bottoms | E21B 6/00 175/321 |
| 3,774,731 | A | 11/1973 | Zerb | |
| 3,958,217 | A | 5/1976 | Spinnler | |
| 4,134,100 | A | 1/1979 | Funke | |
| 4,150,568 | A | 4/1979 | Berger et al. | |
| 4,384,625 | A | 5/1983 | Roper et al. | |
| 4,662,459 | A | 5/1987 | Bodine | |
| 4,703,461 | A | 10/1987 | Kotlyar | |
| 4,715,022 | A | 12/1987 | Yeo | |
| 4,742,498 | A | 5/1988 | Barron | |

(Continued)

*Primary Examiner* — Kenneth L Thompson
*Assistant Examiner* — Steven MacDonald
(74) *Attorney, Agent, or Firm* — Jeffrey L. Wendt; The Wendt Firm, P.C.

(57) ABSTRACT

Systems and methods for producing forced axial vibration of a drillstring. Systems include a cam housing positioned above a drill bit in a drillstring, a rotatable cam positioned internal of the cam housing, the rotatable cam having at least one cam surface exhibiting reciprocating axial movement upon rotation of the rotatable cam, and a non-rotatable cam follower positioned internal surface of the cam housing and having at least one cam follower surface engaging the cam surface. The cam follower transfers the reciprocating axial movement to the drill bit. The rotatable cam is rotated by a fluid-powered positive displacement power section positioned above and mechanically attached to the rotatable cam in the drillstring to effect the rotation of the rotatable cam, and thus effect the reciprocating axial movement of the drill bit.

10 Claims, 4 Drawing Sheets

(56) References Cited

U.S. PATENT DOCUMENTS

| | | | | |
|---|---|---|---|---|
| 4,771,408 | A | 9/1988 | Kotlyar | |
| 5,040,155 | A | 8/1991 | Feld | |
| 5,090,497 | A * | 2/1992 | Beimgraben | F04C 15/0076 175/107 |
| 5,103,430 | A | 4/1992 | Jeter et al. | |
| 5,273,122 | A | 12/1993 | Henneuse | |
| 5,373,481 | A | 12/1994 | Orban et al. | |
| 5,495,237 | A | 2/1996 | Tuasa et al. | |
| 5,540,295 | A | 7/1996 | Serrette | |
| 5,601,152 | A | 2/1997 | Harrison | |
| 6,097,310 | A | 8/2000 | Harrell et al. | |
| 6,227,044 | B1 | 5/2001 | Jarvis | |
| 6,421,298 | B1 | 7/2002 | Beattie et al. | |
| 6,626,253 | B2 | 9/2003 | Hahn et al. | |
| 6,898,150 | B2 | 5/2005 | Hahn et al. | |
| 6,975,244 | B2 | 12/2005 | Hahn et al. | |
| 7,082,821 | B2 | 8/2006 | Chen et al. | |
| 7,123,161 | B2 | 10/2006 | Jeffryes et al. | |
| 7,138,929 | B2 | 11/2006 | Jeffryes et al. | |
| 7,185,715 | B2 | 3/2007 | Krueger et al. | |
| 7,250,873 | B2 | 7/2007 | Hahn et al. | |
| 7,251,590 | B2 | 7/2007 | Huang et al. | |
| 7,280,432 | B2 | 10/2007 | Hahn et al. | |
| 7,377,339 | B2 | 5/2008 | Wassell et al. | |
| 7,429,934 | B2 | 9/2008 | Sim et al. | |
| 7,434,631 | B2 | 10/2008 | Krueger et al. | |
| 7,468,679 | B2 | 12/2008 | Feluch | |
| 7,748,474 | B2 | 7/2010 | Watkins et al. | |
| 7,808,859 | B2 | 10/2010 | Hahn et al. | |
| 7,940,192 | B2 | 5/2011 | Reckmann et al. | |
| 7,997,357 | B2 | 8/2011 | Wassell et al. | |
| 8,042,623 | B2 | 10/2011 | Quernheim et al. | |
| 8,087,476 | B2 | 1/2012 | Wassell et al. | |
| 8,162,078 | B2 | 4/2012 | Anderson | |
| 8,174,404 | B2 | 5/2012 | Hahn et al. | |
| 8,205,691 | B2 | 6/2012 | Bowar et al. | |
| 8,240,401 | B2 | 8/2012 | Wassell et al. | |
| 2002/0117306 | A1 | 8/2002 | Hahn et al. | |
| 2002/0159333 | A1 | 10/2002 | Hahn et al. | |
| 2003/0056985 | A1 | 3/2003 | Hahn et al. | |
| 2003/0151522 | A1 | 8/2003 | Jeffryes et al. | |
| 2003/0151978 | A1 | 8/2003 | Jeffryes et al. | |
| 2004/0012500 | A1 | 1/2004 | Hahn et al. | |
| 2004/0206170 | A1 | 10/2004 | Chen et al. | |
| 2004/0262041 | A1 | 12/2004 | Krueger et al. | |
| 2005/0284624 | A1 | 12/2005 | Libby et al. | |
| 2006/0098532 | A1 | 5/2006 | Sim et al. | |
| 2006/0118334 | A1 | 6/2006 | Hahn et al. | |
| 2006/0195307 | A1 | 8/2006 | Huang et al. | |
| 2006/0243489 | A1 | 11/2006 | Wassell et al. | |
| 2007/0132606 | A1 | 6/2007 | Reckmann et al. | |
| 2007/0144782 | A1 | 6/2007 | Krueger et al. | |
| 2007/0182583 | A1 | 8/2007 | Feluch | |
| 2007/0192071 | A1 | 8/2007 | Huang et al. | |
| 2007/0284148 | A1 | 12/2007 | Wassell et al. | |
| 2007/0289778 | A1 | 12/2007 | Watkins et al. | |
| 2008/0055110 | A1 | 3/2008 | Hahn et al. | |
| 2008/0068929 | A1 | 3/2008 | Hahn et al. | |
| 2008/0074948 | A1 | 3/2008 | Reckmann | |
| 2008/0315471 | A1 | 12/2008 | Wassell et al. | |
| 2009/0229882 | A1 | 9/2009 | Quernheim et al. | |
| 2010/0139977 | A1 | 6/2010 | Watkins et al. | |
| 2010/0139984 | A1 | 6/2010 | West et al. | |
| 2010/0181111 | A1 | 7/2010 | Bowar et al. | |
| 2010/0224410 | A1 | 9/2010 | Wassell et al. | |
| 2010/0258352 | A1 | 10/2010 | Aldraihem et al. | |
| 2010/0326733 | A1 | 12/2010 | Anderson | |
| 2011/0291334 | A1 | 12/2011 | Wassell et al. | |
| 2012/0039151 | A1 | 2/2012 | Farley et al. | |
| 2012/0085581 | A1 | 4/2012 | Wassell et al. | |
| 2012/0193145 | A1 | 8/2012 | Anderson | |
| 2012/0222900 | A1 | 9/2012 | Rodney et al. | |
| 2012/0228028 | A1 | 9/2012 | Turner et al. | |
| 2013/0056283 | A1 | 3/2013 | Wassell et al. | |
| 2013/0186686 | A1 | 7/2013 | Heisig | |
| 2013/0199848 | A1 | 8/2013 | Gust | |
| 2013/0222149 | A1 | 8/2013 | Li et al. | |
| 2015/0315846 | A1* | 11/2015 | Tulloch | C09J 183/04 175/57 |

* cited by examiner

SYSTEMS AND METHODS FOR PRODUCING FORCED AXIAL VIBRATION OF A DRILLSTRING

BACKGROUND INFORMATION

Technical Field

The present disclosure relates generally to the field of drilling subterranean boreholes or wellbores, and more particularly to axial vibration of drillstring during drilling operations.

Background Art

Drilling of extended reach and/or deviated subterranean wells frequently suffer from sticking, sometimes referred to as differential sticking, and/or low rate of penetration. Weight on a drill bit decreases as the deviation angle increases, and frictional forces on lower outside surfaces of drillstrings increases as deviation angle increases. Drill cuttings and sediment collect on the bottom of borehole walls, especially in horizontal drilling, further increasing friction, in extreme cases to the point where a drillstring may not be movable with out some force being imposed on the drillstring. The best way to free a stuck drillstring and improve rate of penetration of the drill bit is to avoid sticking in the first place. It would be advantageous to be able to vibrate a drillstring efficiently, especially in the axial or longitudinal direction of the drillstring, and with as little change in present equipment and operations as possible.

U.S. Pat. No. 7,410,013 discloses boring and drilling apparatus including a rotatable drive shaft, and a cam member and followers for converting rotational motion into reciprocal motion, and a shroud having a cutting edge driven by the cam member and followers. The shroud may be selectively engageable with the cam member and followers, allowing the drive shaft to be removed through the shroud. Also described is a drill string incorporating a similar arrangement, allowing the drill string to be reciprocated within a bore. While an advance in the art, these mechanisms require stud-like cam followers positioned transversely to the drillstring in one or more cam tracks on a stationary member. The cam followers may thus be subject to severe shear forces, requiring frequent replacement, and the cam tracks may become clogged or damaged by the severe down hole conditions.

U.S. Pat. No. 4,408,670 discloses a sub assembly to be inserted between a drill string and a bit having a stabilizer sleeve to engage the walls of a bore hole and hold a first cam against rotation. A second cam is fixed to a drill holder at the lower end of the assembly and is driven in rotation by a rotary driving member extending through the assembly. The cams interengage so that relative rotation between them applies periodic impacts to the drill holder.

U.S. Pat. No. 6,508,317 discloses a downhole flow pulsing apparatus comprising a housing for location in a drillstring, the housing defining a throughbore to permit passage of fluid through the housing. A valve is located in the bore and defines a flow passage. The valve includes a valve member movable to vary the area of the passage to provide a varying fluid flow therethrough. A fluid actuated positive displacement motor is associated with the valve member. In a preferred embodiment, the apparatus is provided in combination with a drill bit and a pressure responsive device, such as a shock-sub, which expands or retracts in response to the varying drilling fluid pressure created by the varying flow passage area. The expansion or retraction of the shock-sub provides a percussive effect at the drill bit. In these types of tools, the fluid surface pumps must generate sufficient pressure to first run the rotor of the downhole positive displacement motor, then sufficient pressure to pass through the varying flow passage area, and lastly build fluid pressure in the shock-sub to provide the percussive effect at the drill bit.

It would be advantageous to be able to more efficiently axially vibrate a drillstring using a positive displacement power section, with as little change in present equipment and operations as possible.

SUMMARY

In accordance with the present disclosure, a positive displacement power section is used to do work, but does not drive a pressure pulsing valve assembly. Instead, systems and methods of the present disclosure use the power section to impart a "hit" or force on an anvil to impart a force and therefore cause a micro extension of the tool to create a vibratory force on the drillstring. Rather than a fluid pressure pulse, systems and methods of the present disclosure use a hitting force (mechanical) force to create the extension of a tool to impart a vibratory force on the drillstring.

A system for producing forced axial vibration of a drillstring comprising:

a cam housing positioned above a drill bit in a drillstring;

a rotatable cam positioned internal of the cam housing, the rotatable cam having at least one cam surface exhibiting reciprocating axial movement upon rotation of the rotatable cam;

a non-rotatable cam follower positioned internal of the cam housing and having at least one cam follower surface engaging the at least one cam surface;

the cam follower and cam housing transferring the reciprocating axial movement to the drill bit; and a fluid-powered positive displacement power section positioned above and mechanically attached to the rotatable cam in the drillstring to effect the rotation of the rotatable cam, and thus effect the reciprocating axial movement of the drill bit.

In certain system embodiments the at least one cam housing, rotatable cam, non-rotatable cam follower, and fluid-powered positive displacement power section are generally cylindrical. The rotatable cam may comprise a generally cylindrical body defining a central longitudinal throughbore, the body having first and second ends, the first end defining the at least one cam surface, and the cam follower may comprise a generally cylindrical body having an external diameter and central longitudinal throughbore substantially equal to those of the rotatable cam body, the cam follower body having first and second ends, the second end defining the at least one cam follower surface. In certain system embodiments, the at least one cam surface comprises at least one cam feature for reciprocating the cam follower axially upon rotational movement of the rotatable cam. In certain system embodiments the at least one cam surface may comprise at least one portion of a circumferential gradually rising slope followed by an abrupt cliff, and the at least one cam follower surface mirrors the at least one cam surface. In certain systems the rotatable cam and non-rotatable cam follower produce an axial vibratory frequency to the drill bit during drilling.

Another aspect of this disclosure is a method of producing forced axial vibration of a drillstring, comprising:

a) in no specific order, connecting a cam housing above a drill bit in a drillstring;

connecting a rotatable cam to a flexible rod output shaft of a positive displacement power section, the flexible rod in turn connected to a rotor of the power section;

positioning the rotatable cam internal of the cam housing, the rotatable cam having at least one cam surface exhibiting reciprocating axial movement upon rotation of the rotatable cam;

positioning a non-rotatable cam follower internal of the cam housing, the cam follower having at least one cam follower surface engaging the at least one cam surface;

b) forcing drilling fluid through the positive displacement power section, rotating the rotor, the flexible rod, and the rotatable cam, and causing reciprocating axial movement of the cam follower;

c) transferring the reciprocating axial movement of the cam follower to the drill bit.

Systems and methods of this disclosure will become more apparent upon review of the brief description of the drawings, the detailed description of the disclosure, and the claims that follow.

BRIEF DESCRIPTION OF THE DRAWINGS

The manner in which the objectives of the disclosure and other desirable characteristics can be obtained is explained in the following description and attached schematic drawings in which:

It is to be noted, however, that the appended drawing FIGS. 1-5 are schematic only, may not be to scale, illustrate only typical embodiments of this disclosure, and are therefore not to be considered limiting of its scope, for the disclosure may admit to other equally effective embodiments.

DETAILED DESCRIPTION

In the following description, numerous details are set forth to provide an understanding of the disclosed systems and methods. However, it will be understood by those skilled in the art that the systems and methods covered by the claims may be practiced without these details and that numerous variations or modifications from the specifically described embodiments may be possible and are deemed within the claims. All U.S. published patent applications and U.S. patents referenced herein are hereby explicitly incorporated herein by reference. In the event definitions of terms in the referenced patents and applications conflict with how those terms are defined in the present application, the definitions for those terms that are provided in the present application shall be deemed controlling. All percentages herein are based on weight unless otherwise specified.

As noted herein, rather than a fluid pressure pulse, systems and methods of the present disclosure use a hitting force (mechanical) force to create the extension of a tool to impart a vibratory force on the drillstring.

Figure 1:
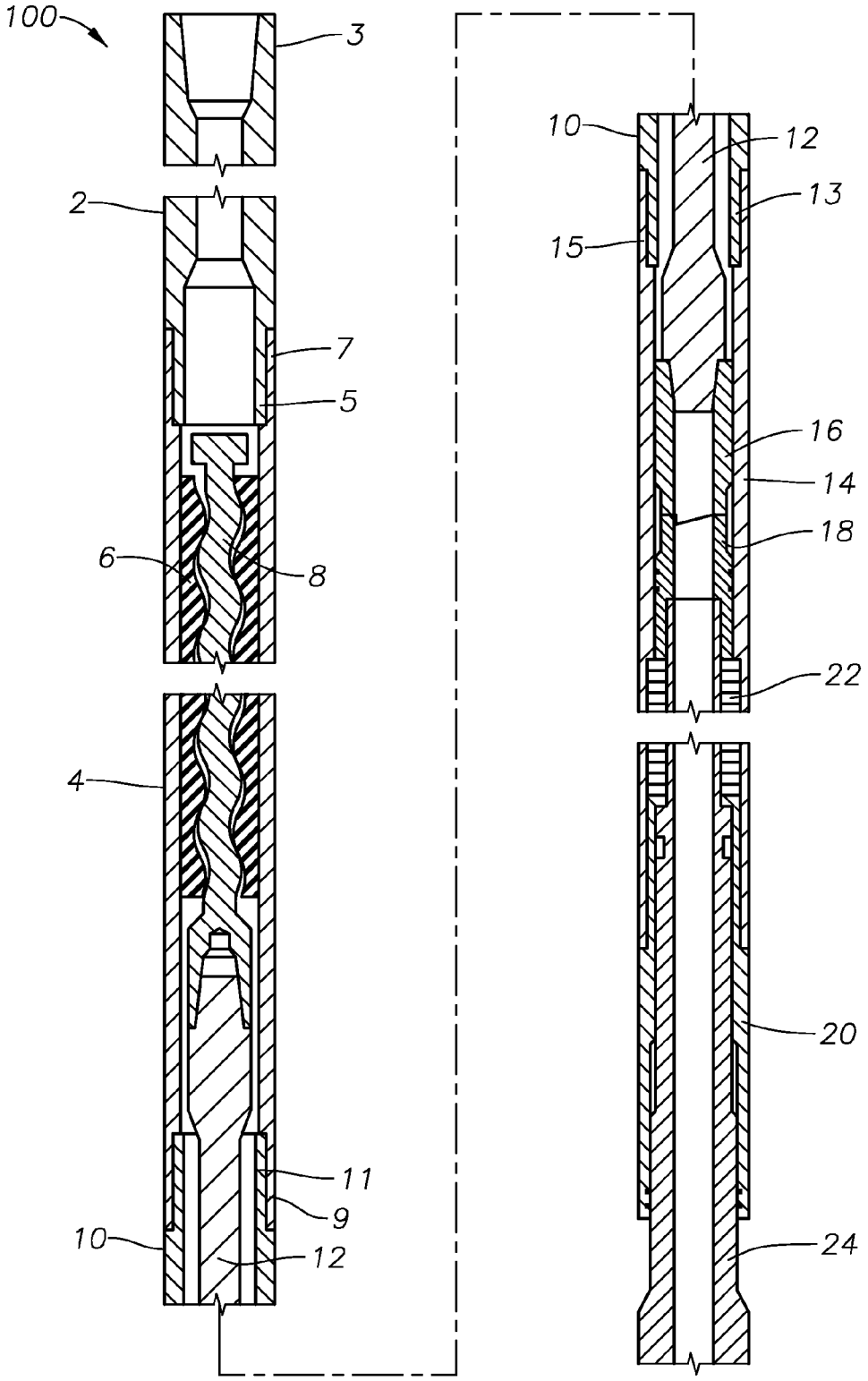
FIG. 1 is a cross-sectional view of one system embodiment in accordance with this disclosure.

FIG. 1 is a cross-sectional view of one system embodiment 100 in accordance with this disclosure. System 100 includes an upper sub 2 that connects upward to a drillstring (not illustrated) via a threaded box 3, and a positive displacement motor (PDM) including a housing 4, a stator 6, and a rotor 8. Upper sub 2 is connected to PDM housing 4 using a threaded pin 5 and a mating threaded box 7 of housing 4, and PDM housing 4 is connected to a pin sub 10 via a threaded box 9 and mating threaded pin 11. Threading may be left-hand or right-hand, depending on rotation of the device. For example, if the device rotates right-hand, the threads are preferably left-hand. A flex rod drive shaft 12 is enclosed by pin sub 10, flex rod 12 connected via threaded fittings to a lower end of PDM rotor 8 and an upper, rotatable cam 16. Rotatable cam 16 and anon-rotatable cam follower 18 are enclosed in a cam housing 14, the latter threadedly connected to pin sub 10 via a threaded pin 13 and mating threaded box 15. Cam follower 18 is able to move axially within cam housing 14, with a lower, first end 48 of cam follower (FIG. 2) abutting springs 22 (stack of Belleville springs or other) in known fashion. A lower end of cam housing 14 telescopically engages a spline housing 20, with lower portions of spline housing 20 enclosing a mandrel 24. Mandrel 24 connects to a drill bit (not illustrated). The dashed line in FIG. 1 indicates that the bottom left-hand portion of the figure is continued on the top right hand side. Preferably, the components are all substantially cylindrical, including upper sub 2, PDM housing 4, pin sub 10, flex rod 12, cam housing 14, cam 16 and cam follower 18, spline housing 20, and mandrel 24. In operation, drilling fluid or mud flows downward between stator 6 and rotor 8 (causing rotation of rotor 8, flex rod 12, and cam 16) and continues flowing downward on the outside of flex rod drive shaft 12, and exits through passages (not illustrated) in the bottom of flex rod drive shaft 12 in known fashion extending from the exterior of flex rod drive shaft 12 to a central bore in rotatable cam 16 to provide for drilling mud flow. As shown in FIG. 1, drilling fluid may then pass through a central bore of rotatable cam 16, cam follower 18, and mandrel 24 to the drill hit. The number of through passages in bottom of flex rod drive shaft 12 is dependent on the total mudflow desired to the bit. For standard applications the number of through passages is four.

Figure 2:
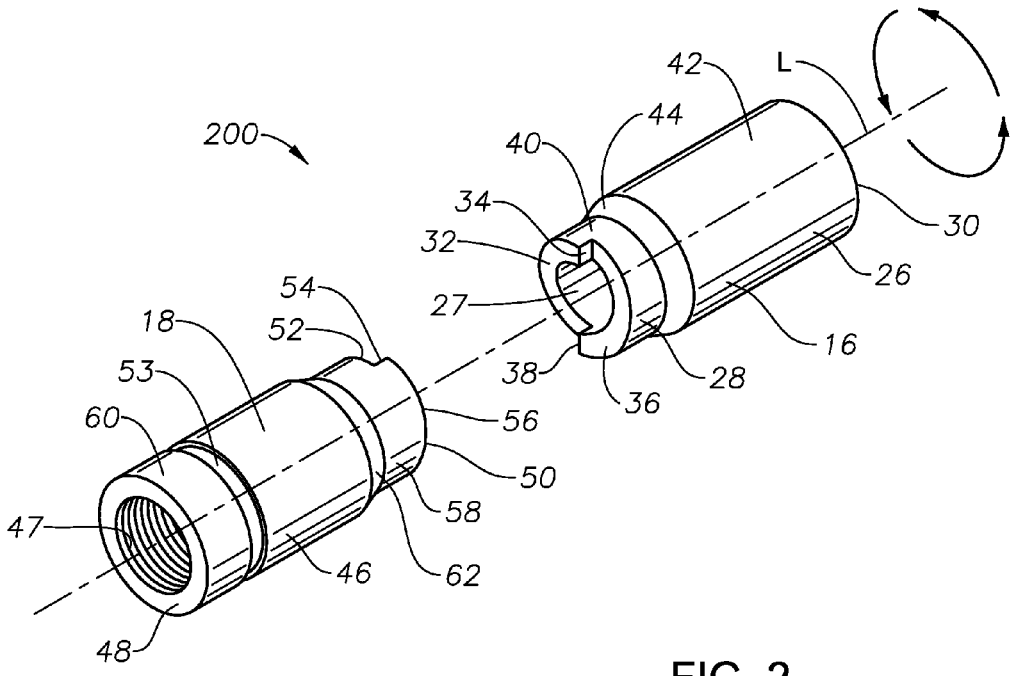
FIG. 2 is a more detailed exploded perspective view of one embodiment of a rotatable cam and non-rotatable cam follower in accordance with the present disclosure.
Figure 3:
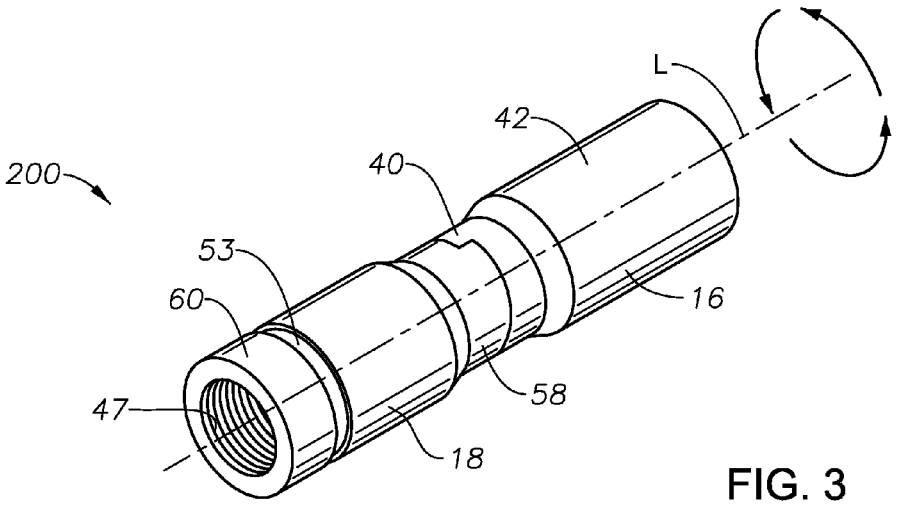
FIG. 3 is a perspective view of the rotatable cam and cam follower of FIG. 2 in assembled form.
Figure 4:
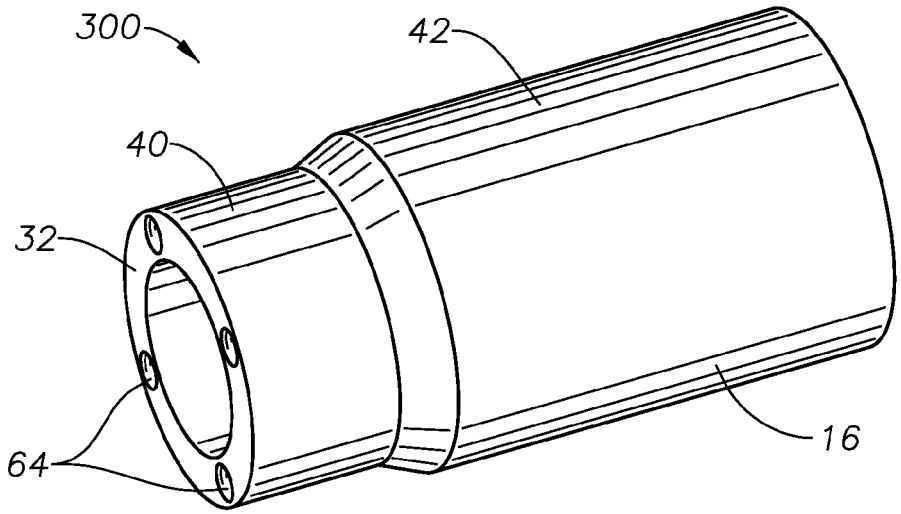
FIGS. 4 and 5 are perspective views of other embodiments of rotatable cams in accordance with the present disclosure.
Figure 5:
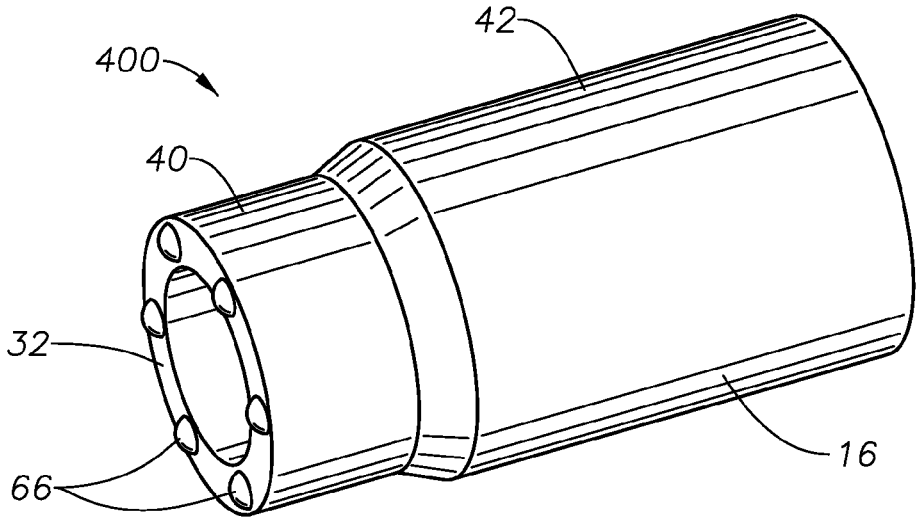

Referring now to FIGS. 2-5, FIG. 2 is a more detailed exploded perspective view of one embodiment 200 of a rotatable cam 16 and non-rotatable cam follower 18 in accordance with the present disclosure, while FIG. 3 is a perspective view of the rotatable cam and cam follower of FIG. 2 in assembled form, and FIGS. 4 and 5 are perspective views of other embodiments (300, 400) of rotatable cams in accordance with the present disclosure. As illustrated in FIGS. 2 and 3, rotatable cam 16 of embodiment 200 includes a cam body 26 defining a central longitudinal bore 27, first and second ends 28, 30, a reduced radius body portion 40, a slightly larger radius body portion 42, and a transition section 44 connecting body portions 40, 42. Rotatable cam 16 includes on its first end 28 at least one cam surface comprising at least one cam feature for reciprocating cam follower 18 axially upon rotational movement of rotatable cam 16, in this embodiment a pair of sloped or gradually increasing height ramps 32, 36, separated by a corresponding pair of abrupt cliffs 34, 38. As rotatable cam 16 rotates clockwise, as illustrated by the circular arrow about longitudinal axis L, corresponding stationary surfaces of non-rotatable cam follower 18 ride up ramps 32, 36 and abruptly fall over cliffs 34, 38, creating periodic "hits" and drillstring vibrations, as will now be described.

Referring again to FIG. 2, non-rotatable cam follower (or lower cam) 18 includes a body 46 defining a central longitudinal bore 47, first and second ends 48, 50, a reduced radius body portion 58, a slightly larger radius body portion 60, and a transition section 62 connecting body portions 58, 60. Cam follower 18 internal bore 47 includes internal threads near end 48 for threading to mandrel 24 (FIG. 1). Cam follower 18 includes on its second end 50 a cam follower surface comprising in this embodiment a pair of sloped or gradually decreasing height ramps 52, 56, that mate with ramps 32, 36, of rotatable cam 16. Ramps 52, 56 are separated by a corresponding pair of abrupt ledges (only one ledge 54 visible in FIG. 2). Cam follower may include one or more external grooves 53 for accommodating lubricant.

FIGS. 4 and 5 are perspective views of other embodiments (300, 400) of rotatable cams 16 in accordance with the present disclosure. Rotatable cam 16 of embodiment 300 illustrated schematically in FIG. 4 includes a plurality of cup-like depressions 64 in cam surface 32. Depressions 64 may interface with corresponding protrusions in cam follower 18 (not illustrated) in similar fashion as rotatable cam 16 and cam follower 18 in FIGS. 2 and 3. Alternatively, rotatable cam 16 of embodiment 400 illustrated schematically in FIG. 5 may include a plurality of protrusions 66 in cam surface 32. Protrusions 66 may interface with corresponding depressions in cam follower 18 (not illustrated) in similar fashion as rotatable cam 16 and cam follower 18 in FIGS. 2 and 3.

Optionally, the cylindrical body 46 of cam follower 18 has an external diameter and central longitudinal throughbore diameter substantially equal to those of rotatable cam body 26. Also optionally, the at least one cam follower surface mirrors the at least one cam surface, although this is not strictly necessary. The primary requirement is that rotatable cam 16 and non-rotatable cam follower 18 have features producing an axial vibratory frequency to the drill bit and/or drillstring during drilling.

Furthermore, where threaded connections are indicated, they are preferably tapered threaded connections, however this is not strictly required.

In certain embodiments, the rotatable cam 16 and non-rotatable cam follower 18 have an outer diameter (OD) of the larger section ranging from about 1.5 inch up to about 10 inches or larger (3.8 cm to 25.4 cm), with OD of the reduced diameter portions being proportionately smaller. The ID of the central longitudinal bore of rotatable cam 16 and cam follower 18 depend on the OD of the reduced diameter portions, but generally may range from about 0.5 inch up to about 5 inches (1.27 cm to 12.7 cm).

Referring again to FIG. 2, the range of height of surfaces 32 and 36 from lowest to highest point depends on how great a "hit" force is desired. If the highest point is 0.5 inch (1.27 cm) above the lowest point, this will produce a certain magnitude of force. The magnitude of force will be higher if the highest point is 1.0 inch above the lowest point, and so on, given the same rotation rate and downward force exerted on the drillstring. In certain embodiments the "cliffs" and "ledges" may be angled to the longitudinal axis at an angle "a" ranging from about 10 to about 45 degrees, the angle "a" measured from a line perpendicular to the longitudinal axis "L" to a line through the face of the cliff or ledge. In certain embodiments the faces of the cliffs and ledges may be slightly radiused or convexly curved to provide a smoother transition from ramp to cliff.

In embodiment 300 illustrated schematically in FIG. 4, depressions 64 may have a range of depth similar the range of height of surfaces 32 and 36 in embodiment 200, and may have a diameter somewhat dependent on the diameter of the cam body, but in general may range from about 0.25 inch up to about 2.0 inches (0.635 cm to 5.08 cm). Similarly, the height of protrusions 66 of embodiment 400 illustrated schematically in FIG. 5 may have a range of height similar the range of height of surfaces 32 and 36 in embodiment 200, and a diameter similar to that of depressions 64 of embodiment 300. It will be understood that depressions 64 and protrusions 66 need not be circular; moreover, it is not strictly necessary that the features on the rotatable cam mirror the surface features of the cam follower. It is only necessary that the features are capable of producing the requisite axial movement with random or non-random frequency of hits.

In certain embodiments, the at least one cam feature for reciprocating cam follower 18 axially upon rotational movement of the rotatable cam 16, such as the pair of sloped or gradually increasing height ramps and corresponding pair of abrupt cliffs, in embodiment 200 of FIG. 2 may be comprised of harder material than the bodies of rotatable cam 16 and non-rotatable cam follower 18. For example, these features may comprise materials such as tungsten carbide, or some combination of tungsten carbide pieces tack welded to the surface and surrounded by a matrix material comprising the same or different carbide particles in a suitable binder, such as disclosed in my co-pending U.S. provisional patent application Ser. No. 61/886,347, filed Oct. 3, 2013, now U.S. Pat. No. 9,279,289, issued Mar. 8, 2016. In certain embodiments, these features may comprise a plurality of tungsten carbide portions surrounded by a hard metal alloy matrix, the hard metal alloy matrix comprising at least one carbide selected from carbides of chrome, carbides of boron, and mixtures thereof, the remainder of the hard metal alloy matrix comprising a binder metal selected from iron, cobalt, nickel, and mixtures thereof. The at least one carbide in the matrix material may be present at a weight percentage of at least 30 weight percent, or at least 35, or 40, or 45, or 50, or 55, or 60, or 65, or 70, or 75, or at least 80 weight percent, based on total weight of the at least one carbide and binder. More carbide will tend to increase wear resistance of the surfaces, but may also reduce their toughness.

Figure 6:
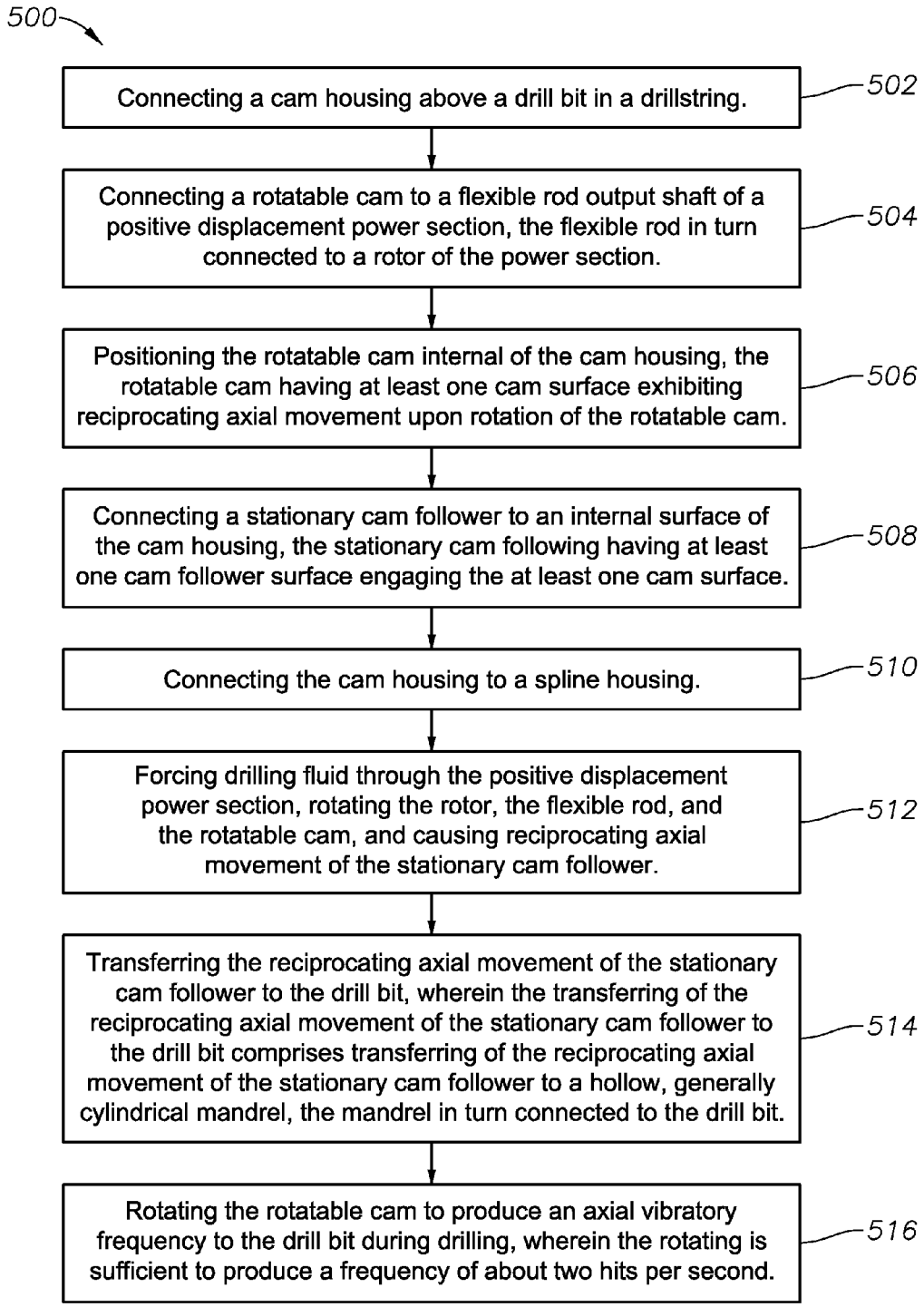
FIG. 6 is a logic diagram of one method embodiment in accordance with the present disclosure.

One preferred method embodiment of using a system of the present disclosure is presented schematically in the logic diagram of FIG. 6. Method embodiment 500 comprises, in no particular order, connecting a cam housing above a drill bit in a drillstring (box 502), connecting a rotatable cam to a flexible rod output shaft of a positive displacement power section, the flexible rod in turn connected to a rotor of the power section (box 504); positioning the rotatable cam internal of the cam housing, the rotatable cam having at least one cam surface exhibiting reciprocating axial movement upon rotation of the rotatable cam (box 506); connecting a stationary (i.e., non-rotatable) cam follower to an internal surface of the cam housing, the stationary cam following having at least one cam follower surface engaging the at least one cam surface (box 508); and connecting the cam housing to a spline housing (box 510). Method embodiment 500 further comprises forcing drilling fluid through the positive displacement power section, rotating the rotor, the flexible rod, and the rotatable cam, and causing reciprocating axial movement of the stationary cam follower (box 512). Method embodiment 500 further comprises transferring the reciprocating axial movement of the stationary cam follower to the drill bit, wherein the transferring of the reciprocating axial movement of the stationary cam follower to the drill bit comprises transferring of the reciprocating axial movement of the stationary cam follower to a hollow, generally cylindrical mandrel, the mandrel in turn connected to the drill bit (box 514), and rotating the rotatable cam to produce an axial vibratory frequency to the drill bit during drilling, wherein the rotating is sufficient to produce a frequency of about two hits per second (box 516). The frequency of hits may range from a low frequency of about 1 hit per 20 seconds up to a high frequency of 10 hits per second, depending on the configuration of the cam features on the rotatable cam and/or cam follower, or from about 1 hit per 10 seconds up to about 5 hits per second.

System components, such as mandrels, housing members, cam bodies, flex rod drive shafts, and associated components used in assemblies of the present disclosure may be comprised of metal, ceramic, ceramic-lined metal, or combination thereof. Suitable metals include carbon steels, stainless steels, for example, but not limited to, 41xx-43xx series aircraft quality steels, hardened versions of these, as well as titanium alloys, and the like. These components may comprise the same or different corrosion resistant and/or fatigue resistant material, at least one of the corrosion and/or fatigue resistance being able to withstand the expected down hole service conditions experienced during a drilling or other operation.

The choice of a particular material is dictated among other parameters by the rock strata properties such as hardness and porosity, as well as the chemistry, pressure, and temperature of drilling mud and type of formation fluid(s) and other fluids, such as treatment fluids, to be encountered. The skilled artisan, having knowledge of the particular application, pressures, temperatures, and available materials, will be able design the most cost effective, safe, and operable system components, such as cams and cam followers mandrels, sleeves, housing members, and associated components used in systems of the present disclosure for each particular application without undue experimentation.

System components, such as cam bodies, cam surface features, mandrels, housing members, flex rod drive shafts, and associated components used in systems of the present disclosure may be made using a variety of processes, including molding, machining, net-shape cast (or near-net shape cast) using rapid prototype (RP) molds and like processes.

Metal matrix materials useful as binders include hard metal alloys (available from companies such as Oryx Stainless). Hard metal alloys are composed mainly of (up to 95%) highly enameled, very hard carbides, either of one carbide type or of a carbide of varying types (W, Ti, Ta, Nb). Furthermore chrome or boron carbide as well as compounds of hard materials with nitrogen may be present. The remainder is binder phase, Fe, Co or Ni. Co is the most used. Whereas carbide increases the abrasion resistance and cutting property, the binder phase may maintain or increase toughness and bending strength. These alloys are produced through pulverization. Binding phase and hard materials are mixed to a powder. The powder is then pressed and sintered at temperatures higher than the melting point of the binding phase. The structure then has the appearance of rolled balls of carbide, with a binding phase filling. Durometer or Hardness Range of the matrix material may range from 20 to about 60 (Shore D, according to ASTM 2240).

In certain embodiments it may be useful to employ tack welding to adhere tungsten carbide pieces or regions onto the cam surface of the rotatable cam and/or cam follower. Tack welding of tungsten carbide shaped features may work well in high flow rate down hole environments.

Although only a few exemplary embodiments of this disclosure have been described in detail above, those skilled in the art will readily appreciate that many modifications are possible in the exemplary embodiments without materially departing from the novel teachings and advantages of this disclosure. For example, the transition sections 44 and 62 mentioned herein may not be necessary or present in all embodiments. Accordingly, all such modifications are intended to be included within the scope of this disclosure as defined in the following claims. In the claims, no clauses are intended to be in the means-plus-function format allowed by 35 U.S.C. §112, Section F, unless "means for" is explicitly recited together with an associated function. "Means for" clauses are intended to cover the structures, materials, and acts described herein as performing the recited function and not only structural equivalents, but also equivalent structures.

What is claimed is:

1. A system for producing forced axial vibration of a drillstring comprising:

a cam housing positioned above a drill bit in a drillstring;

a rotatable cam positioned internal of the cam housing; the rotatable cam having at least one cam surface exhibiting reciprocating axial movement upon rotation of the rotatable cam, the rotatable cam comprising a generally cylindrical body defining a central longitudinal throughbore, the body having first and second ends, the first end defining the at least one cam surface;

a non-rotatable cam follower positioned internal of the cam housing and having at least one cam follower surface engaging the at least one cam surface, the non-rotatable cam follower comprising a generally cylindrical body having a central longitudinal throughbore substantially equal in diameter to that of the rotatable cam body, the cam follower body having first and second ends, the second end defining the at least one cam follower surface;

the first end of the non-rotatable cam follower includes a threaded connection to a hollow, generally cylindrical mandrel, the mandrel in turn threadedly connected to the drillstring, the cam housing threadedly connected to a spline housing, the mandrel and spline housing connected through a spring-biased spline connection;

the cam follower transferring the reciprocating axial movement to the drillstring producing an axial vibratory frequency to the drill string during drilling;

a fluid-powered positive displacement power section positioned above and mechanically attached to the rotatable cam in the drillstring to effect the rotation of the rotatable cam, and thus effect the reciprocating axial movement of the drillstring;

wherein the second end of the rotatable cam includes a connection to a first end of a solid flexible rod, the solid flexible rod contained within a pin sub, the first end of the solid flexible rod including passages extending from an external surface of the solid flexible rod to the central longitudinal throughbore of the rotatable cam, the solid flexible rod having a second end connected to a lower end of a solid rotatable rotor of the fluid-powered positive displacement power section.

2. The system according to claim 1 wherein the at least one cam housing, and fluid-powered positive displacement power section are generally cylindrical.

3. The system according to claim 1 wherein:

the at least one cam surface comprises at least one cam feature for reciprocating the cam follower axially upon rotational movement of the rotatable cam.

4. The system according to claim 3 wherein:

the at least one cam surface comprises at least one portion of a circumferential gradually rising slope followed by an abrupt cliff; and the at least one cam follower surface mirrors the at least one cam surface.

5. The system according to claim 1 wherein the pin sub is threadedly connected to the cam housing and a housing of the fluid-powered positive displacement power section.

6. A system for producing forced axial vibration of a drillstring comprising:

a generally cylindrical cam housing positioned above a drill bit in a drillstring;

a generally cylindrical rotatable cam body positioned internal of the cam housing, the rotatable cam body defining a central longitudinal throughbore and first and second ends, the first end defining at least one cam surface exhibiting reciprocating axial movement upon rotation of the rotatable cam, the at least one cam surface comprising at least one portion of a circumferential gradually rising slope followed by an abrupt cliff;

a generally cylindrical non-rotatable cam follower body fixed to an internal surface of the cam housing and having an external diameter and central longitudinal throughbore substantially equal to those of the rotatable cam body, the cam follower body having first and second ends, the first end abutting a spring positioned in the cam housing, the second end defining at least one cam follower surface configured to engage the at least one cam surface, the at least one cam follower surface configured to mirror the at least one cam surface;

the rotatable cam and cam follower producing an axial vibratory frequency to the drillstring during drilling;

a fluid-powered positive displacement power section positioned above and mechanically attached to the second end of the rotatable cam in the drillstring via a solid flexible rod to effect the rotation of the rotatable cam, and thus effect the axial vibratory frequency to the drillstring;

the second end of the rotatable cam connected to a first end of the solid flexible rod, the solid flexible rod contained within a pin sub, the first end of the solid flexible rod including passages extending from an external surface of the solid flexible rod to the central longitudinal throughbore of the rotatable cam, the solid flexible rod having a second end connected to a lower end of a solid rotatable rotor of the fluid-powered positive displacement power section;

the pin sub is threadedly connected to the cam housing and a housing of the fluid-powered positive displacement power section;

the first end of cam follower includes a threaded connection to a hollow, generally cylindrical mandrel, the mandrel in turn threadedly connected to the drillstring; and wherein the cam housing is threadedly connected to a spline housing, and the mandrel and spline housing are connected through a spring-biased spline connection.

7. A method of producing forced axial vibration of a drillstring, comprising:

a) in no specific order, connecting a cam housing above a drill bit in a drill string;

connecting a rotatable cam to a solid flexible rod output shaft of a positive displacement power section having a solid rotatable rotor and a stationary stator external of the rotor, the solid flexible rod in turn connected to a lower end of the solid rotatable rotor of the power section;

positioning the rotatable cam internal of the cam housing, the rotatable cam having at least one cam surface exhibiting reciprocating axial movement upon rotation of the rotatable cam;

positioning a non-rotatable cam follower having first and second ends internal of the cam housing, the cam follower having at least one cam follower surface on its second end engaging the at least one cam surface;

positioning a spring in the cam housing abutting the first end of the non-rotatable cam follower, threading the first end of the non-rotatable cam follower to a hollow, generally cylindrical mandrel, the mandrel in turn threadedly connected to the drillstring the cam housing threadedly connected to a spline housing, the mandrel and spline housing connected through a spring-biased spline connection;

b) forcing drilling fluid through the positive displacement power section outside of the solid rotatable rotor and solid flexible rod, and through passages in the first end of the solid flexible rod extending from an external surface of the solid flexible rod to the central longitudinal throughbore of the rotatable cam, rotating the solid rotatable rotor, the solid flexible rod, and the rotatable cam, and causing reciprocating axial movement of the cam follower;

c) transferring the reciprocating axial movement of the cam follower to drillstring causing forced axial vibration of the drillstring.

8. The method of claim 7 wherein the rotating is sufficient to produce a vibration frequency of the drillstring ranging from about 1 hit per 20 seconds up to about 10 hits per second.

9. The method of claim 8 wherein the frequency ranges from about 1 hit per 10 seconds up to about 5 hits per second.

10. The method of claim 9 wherein the frequency is about two hits per second.

* * * * *